US009852869B2

(12) United States Patent
Wang et al.

(10) Patent No.: US 9,852,869 B2
(45) Date of Patent: Dec. 26, 2017

(54) SWITCH MODULE WITH A BUILT-IN STRUCTURE OF ANTI-SURGE AND DUAL DISCONNECTION

(71) Applicants: Yi-Hsiang Wang, Taoyuan (TW); I-Ying Wang, Taoyuan (TW)

(72) Inventors: Yi-Hsiang Wang, Taoyuan (TW); I-Ying Wang, Taoyuan (TW)

( * ) Notice: Subject to any disclaimer, the term of this patent is extended or adjusted under 35 U.S.C. 154(b) by 0 days.

(21) Appl. No.: 15/389,885

(22) Filed: Dec. 23, 2016

(65) Prior Publication Data

US 2017/0148602 A1 May 25, 2017

Related U.S. Application Data

(63) Continuation-in-part of application No. 14/950,069, filed on Nov. 24, 2015.

(51) Int. Cl.

| | |
|---|---|
| ***H01H 89/04*** | (2006.01) |
| *H01H 23/20* | (2006.01) |
| *H01H 9/02* | (2006.01) |

(52) U.S. Cl.

CPC ..... *H01H 89/04* (2013.01); *H01H 9/0271* (2013.01); *H01H 23/20* (2013.01); *H01H 2205/002* (2013.01); *H01H 2235/028* (2013.01)

(58) Field of Classification Search

CPC ..... H01H 89/04; H01H 2235/028; H01H 2205/002; H01H 2235/01

USPC ... 337/190, 98, 160, 290, 401, 404, 52, 148, 337/195, 342

See application file for complete search history.

(56) References Cited

U.S. PATENT DOCUMENTS

| | | | | |
|---|---|---|---|---|
| 3,562,689 | A * | 2/1971 | Bar | H01H 23/025 337/77 |
| 4,345,233 | A * | 8/1982 | Matthies | H01H 23/00 307/141 |
| 7,248,140 | B2 * | 7/2007 | Yu | H01H 71/7436 337/56 |
| 7,688,174 | B2 * | 3/2010 | Hung | H01H 23/025 337/56 |
| 8,378,778 | B2 * | 2/2013 | Duval | H01C 7/126 338/13 |
| 2001/0006145 | A1 * | 7/2001 | Yu | H01H 73/30 200/524 |
| 2009/0009921 | A1 * | 1/2009 | Wosgien | H01C 7/12 361/127 |

(Continued)

*Primary Examiner* — Jayprakash N Gandhi
*Assistant Examiner* — Stephen Sul
(74) *Attorney, Agent, or Firm* — Rosenberg, Klein & Lee

(57) ABSTRACT

A switch module with a built-in structure of anti-surge and dual disconnection mainly comprises an overcurrent protection switch having plates and insulating elements for anti-surge and dual disconnection structure ingeniously built inside a heat-resisting housing. The switch module has a first connecting point and a second connecting point for operation. When overvoltage occurs, temperature of at least one metal oxide varistor would instantly rise up to a degree higher than the melting point thereof, melting at least one thermo-sensitive piece, loosening at least one spring element, displacing a pushing element and thus forcing the connecting points detaching from each other to turn off the switch and stop supplying electricity power; meanwhile, insulating elements would isolate conductive components such as thermo-sensitive pieces, spring elements and plates to further ensure a complete disconnection and more of electricity safety.

9 Claims, 15 Drawing Sheets

(56) References Cited

U.S. PATENT DOCUMENTS

2011/0109421 A1* 5/2011 Lee ..... H01H 9/0271
337/112

* cited by examiner

SWITCH MODULE WITH A BUILT-IN STRUCTURE OF ANTI-SURGE AND DUAL DISCONNECTION

This patent application is a continuation-in-part of Ser. No. 14/950,069 filed on Nov. 24, 2015, currently pending.

BACKGROUND OF THE INVENTION

1. Field of the Invention

The present invention relates to a switch module with a built-in structure of anti-surge and dual disconnection, particularly to one that has conductive plates disconnecting a series connection and an anti-surge structure disconnecting a parallel connection by insulation elements.

2. Description of the Related Art

FIGS. 1A and 1B disclose a conventional overcurrent protection switch 10 that has plural connecting points arranged in the middle part and comprises a housing 11 with a press button 12 on the top, a first terminal 12*a*, a second terminal 12*b*, a third terminal 12*c* separately arranged at the bottom, and a moving element 14. The first terminal 12*a* has a bimetal plate 13 and a first contact 131; the second terminal 12*b* has a second contact 121 corresponding to the first contact 131. The moving element 14 has one end linking the bottom of the press button 12 and the other linking the moving terminal of the bimetal plate 13, whereby the pressing of the press button 12 actuates the first contact 131 connecting to the second contact 121 and therefore turns on the device; while overcurrent occurs, the bimetal plate 13 deforms due to high degree of temperature and disconnects the first and second contact 131, 121, turning off the device so as to form an overcurrent protection switch 10. Such structure can be found in Taiwan patent applications No. 540811, 367091, 320335, 262168, and 208384. However, the structure disclosed above aims at protection from overcurrent situation but is not able to protect the device when sudden overvoltage such as lightning strike occurs.

Therefore, for safety concern, a usual solution to the defect is to parallel connect to a metal oxide varistor, and to connect to a thermal fuse in series.

FIG. 2A is the invention of U.S. Pat. No. 8,643,462. It discloses an anti-surge switch module applied in an electric system. The switch module comprises a power switch 105, an insulating member 106, a surge absorber 107 and a pyrocondensation belt 108. The insulating member 106 engages with the power switch 105 that abutting against the surge absorber 107; and the pyrocondensation belt 108 ties the surge absorber 107 and the insulating member 106 together so that it could contract when receiving the heat from the surge absorber 107 and thus turn off the power switch 105 under certain degree of contracting. However, the insulating member 106, the surge absorber 107 and the pyrocondensation belt 108 are not disposed inside the power switch 105 but are connected outside, failing to form a complete device with the power switch 105.

In short, the structures disclosed above have shortcomings as uncertain quality, possible exceeding heat due to external connection of components, slow reaction, large volumes, and complicated composition, and they require more constructing space and procedures. Besides, the protection device has to be connected independently outside instead of having one inside.

In UL 1449 3$^{rd}$ Edition (2009) Type 4 was added to Surge Protective Devices (SPDs) requirements. The 3$^{rd}$ Edition also includes the Low voltage Surge Arresters under 1000V in the requirements, and the title is also altered from Transient Voltage Surge Suppressors into Surge Protective Devices. This shows the importance of integrating the components and the surge arresters function of the device.

Hence, the inventor has an invention in U.S. patent application Ser. No. 14/617,000 filed on Feb. 9, 2015 which has an anti-surge disconnection structure built inside a heat-resisting and fireproof housing of an overcurrent protection switch so that the disconnection could be operated successfully and instantly when an overload occurs. Features of the invention disclosed are illustrated in FIG. 2B. A band 74 having a first end 741 and a second end 742 fixedly adhered on a surface of a metal oxide varistor 71 by a thermo-sensitive piece 72 to have the band 74 tightly compressing a spring 73 by wrapping it up. When overvoltage occurs, the metal oxide varistor 71 heats up and melts down the thermo-sensitive piece 72 instantly and therefore loosens the band 74 for the spring 73 to eject upwards to push a pushing rod 75 and disconnect the circuit.

Still, the inventor has continued to develop such feature and further designed a switch module disclosed in U.S. patent application Ser. No. 14/950,069 filed on Nov. 24, 2015. The switch module has provides the same effect in operation as the previous one. The invention also has a built-in structure that can melt down a thermo-sensitive piece by a heating metal oxide varistor for a spring element to be loosened and has an outer periphery thereof displacing a pushing rod, so as to detach a first contacting point from a second contacting point, thus disconnecting the circuit. However, both inventions can only disconnect the circuit of series connection, but cannot ensure the structure therein is completely disconnected. That is, the outer periphery of the spring element would still contacting surfaces of the metal oxide varistor; and if the entire structure cannot be disconnected thoroughly, the circuit may still be working and keep heating up, resulting in a dangerous situation.

On the other hand, metal oxide varistors are prone to operate function less effectively after in use for a period. To overcome such issue, manufacturers usually have a fuse connected to a metal oxide varistor for safety concerns, and the inventor therefore tries to improve such structure with a simpler and easier manufacturing process and better effectiveness based on structures of the previous inventions mentioned above.

SUMMARY OF THE INVENTION

A primary object of the present invention is to provide a switch module with a built-in structure of anti-surge and dual disconnection that has the original function of overcurrent protection and further includes dual disconnection structure for anti-surge to ensure more of electricity safety. The switch module has a conductive colloid thermo-sensitive piece fixedly compressing a conductive spring element and an insulating element for complete disconnection.

Another object of the present invention is to ensure a complete disconnection even when conductive plates fail to disconnect a circuit within the switch.

Yet another object of the present invention is to accomplish qualifications of the surge standards in UL 1449 3$^{rd}$ edition.

To achieve the objects mentioned above, the present invention comprises a housing having a press button arranged atop thereof, and a first conductive plate, a second conductive plate and a third conductive plate arranged at a lower section thereof; said first conductive plate being connected to a binary alloy conductive plate having a first connecting point, and the second conductive plate having a second connecting point on the surface of an upper section thereof corresponding to the first connecting point; a moving rod linking up the bottom of the press button with one end and the binary alloy conductive plate with the other end for the first connecting point to contact the second connecting point, consequently turning on the switch, and for the first connecting point to detach from the second connecting point when current overload occurs and the binary alloy conductive plate is deformed due to high temperature, consequently turning off the switch, so as to form an overcurrent protection switch;

Wherein a structure of anti-surge and dual disconnection is built inside the housing, including: at least one metal oxide varistor being disposed under a plate and having a first surface and an opposite second surface; at least one insulating element having a through hole arranged at a center thereof, an upper surface and a lower surface, said upper surface arranged correspondingly to the first surface of the metal oxide varistor; at least one conductive spring element having an outer periphery with an extended portion connecting the first surface of the metal oxide varistor with the second conductive plate, and a springy section being compressed by the first surface of the metal oxide varistor in the through hole of the insulating element; at least one thermo-sensitive piece which is conductive and solid colloid to be disposed in the through hole of the insulating element for the springy section of the spring element to be adhered between the lower surface of the insulating element and the first surface of the metal oxide varistor for electrical connection and for the spring element to be conductive and ready for ejection; and a pushing element having a first end thereof arranged correspondingly to the metal oxide varistor, the insulating element and the springy section of the spring element, and a second end thereof arranged correspondingly to the binary alloy conductive plate for pushing;

Whereby when the first connecting point is contacting the second connecting point and an overvoltage occurs, temperature of the metal oxide varistor would instantly rise up to a degree higher than the melting point thereof, therefore melting the thermo-sensitive piece, loosening the springy section of the spring element and displacing the pushing element to force the first connecting point detaching from the second connecting point and turn off the switch; meanwhile, the insulating element also disconnects the circuit structure simultaneously.

With structures disclosed above, the present invention complements the defect of a conventional overcurrent protection switch that it has to connect to a metal oxide varistor from the outside by having the anti-surge disconnection structure ingeniously built inside the heat-resisting and fireproof housing. When receiving exceedingly high voltages, the heating metal oxide varistor would instantly melt down the thermo-sensitive piece, loosening the springy section of the conductive spring element for ejection and further displacing the pushing element, therefore forcing the first connecting point detaching from the second connecting point and turning off the switch immediately. Therefore, the present invention is not only overcurrent protective but also overvoltage protective and surge absorbing; also, the insulating element is able to completely disconnect the thermo-sensitive piece and the spring element from the metal oxide varistor by insulation, ensuring more electricity safety and conveniences in using.

DETAILED DESCRIPTION OF THE PREFERRED EMBODIMENT

Figure 1A:
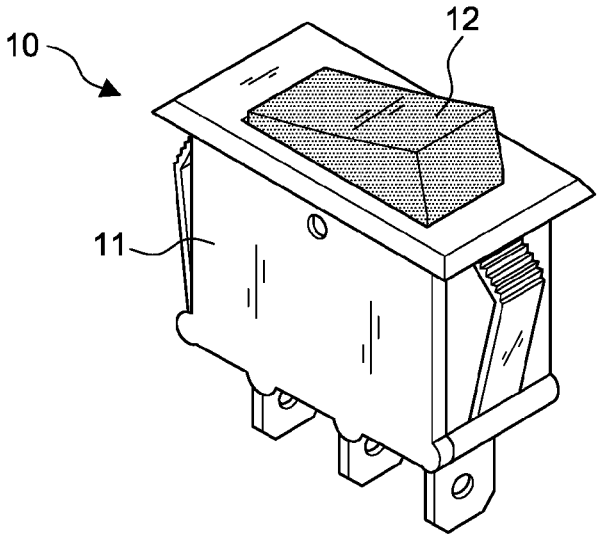
FIG.1A PRIOR ART
FIG. 1A is a perspective view of an overcurrent protection switch according to the prior art.
Figure 1B:
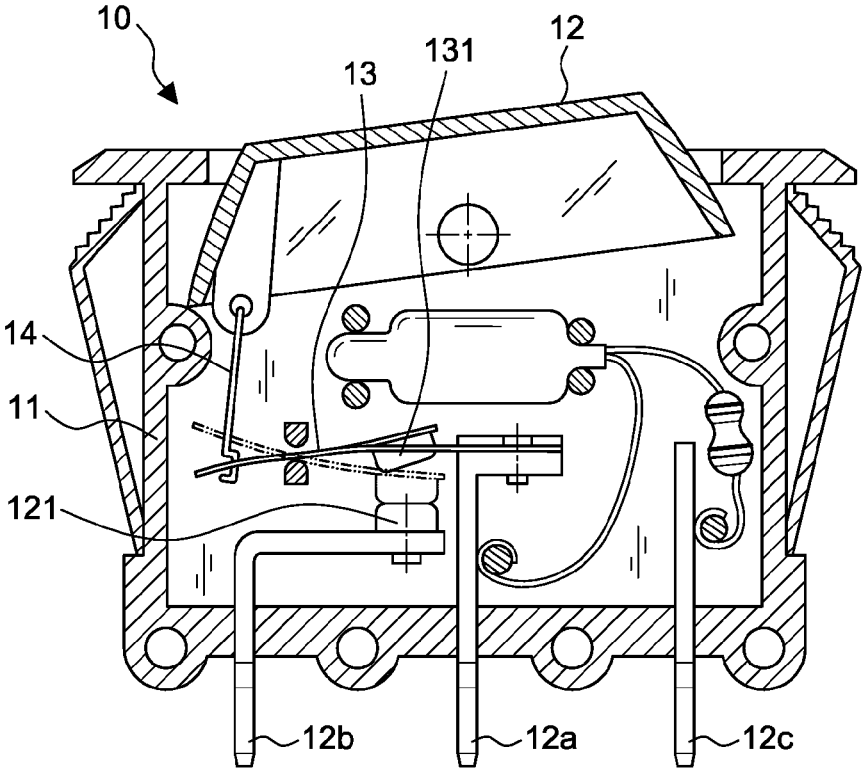
FIG.1B PRIOR ART
FIG. 1B is a section view of an overcurrent protection switch according to the prior art.
Figure 2A:
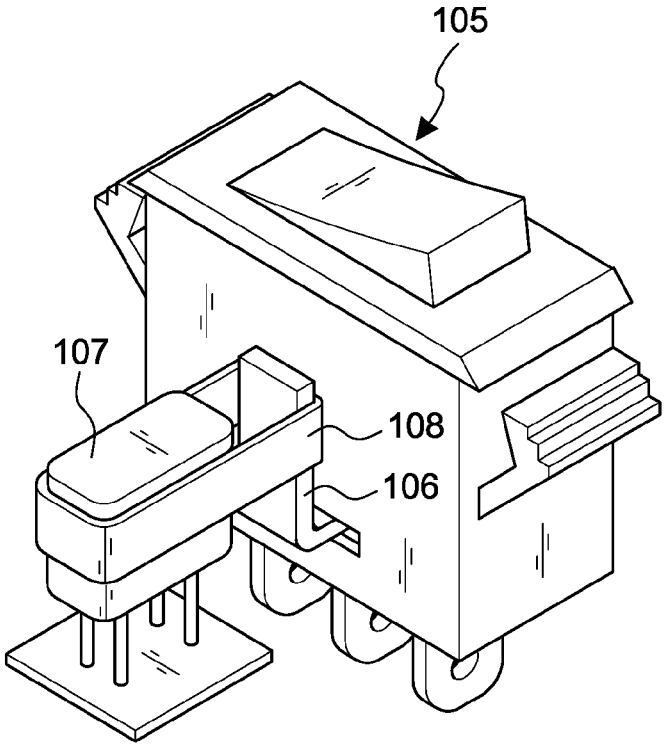
FIG.2A PRIOR ART
FIG. 2A is a perspective view of an anti-surge disconnection structure according to U.S. Pat. No. 8,643,462.
Figure 2B:
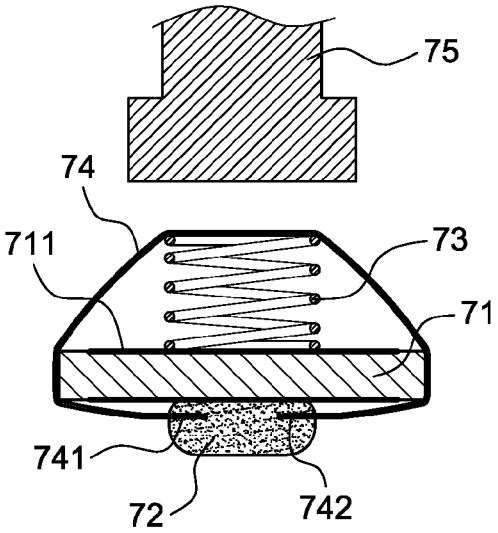
FIG.2B PRIOR ART
FIG. 2B is a perspective view of a major structure according to U.S. Ser. No. 14/617,000.

Referring to FIGS. 3-6, in a first embodiment, the present invention mainly includes a housing 31, a moving rod 33, and an anti-surge disconnection structure 70.

The housing 31 has a press button 32 arranged atop thereof, and a first conductive plate 40 as a positive electrode, a second conductive plate 50 as another positive electrode and a third conductive plate 60 as a negative electrode arranged at a lower section thereof. The first conductive plate 40 is connected to a binary alloy conductive plate 41 that has a spring leaf 42 and a first connecting point 421, and the second conductive plate 50 has a second connecting point 511 corresponding to the first connecting point 421.

Figure 3:
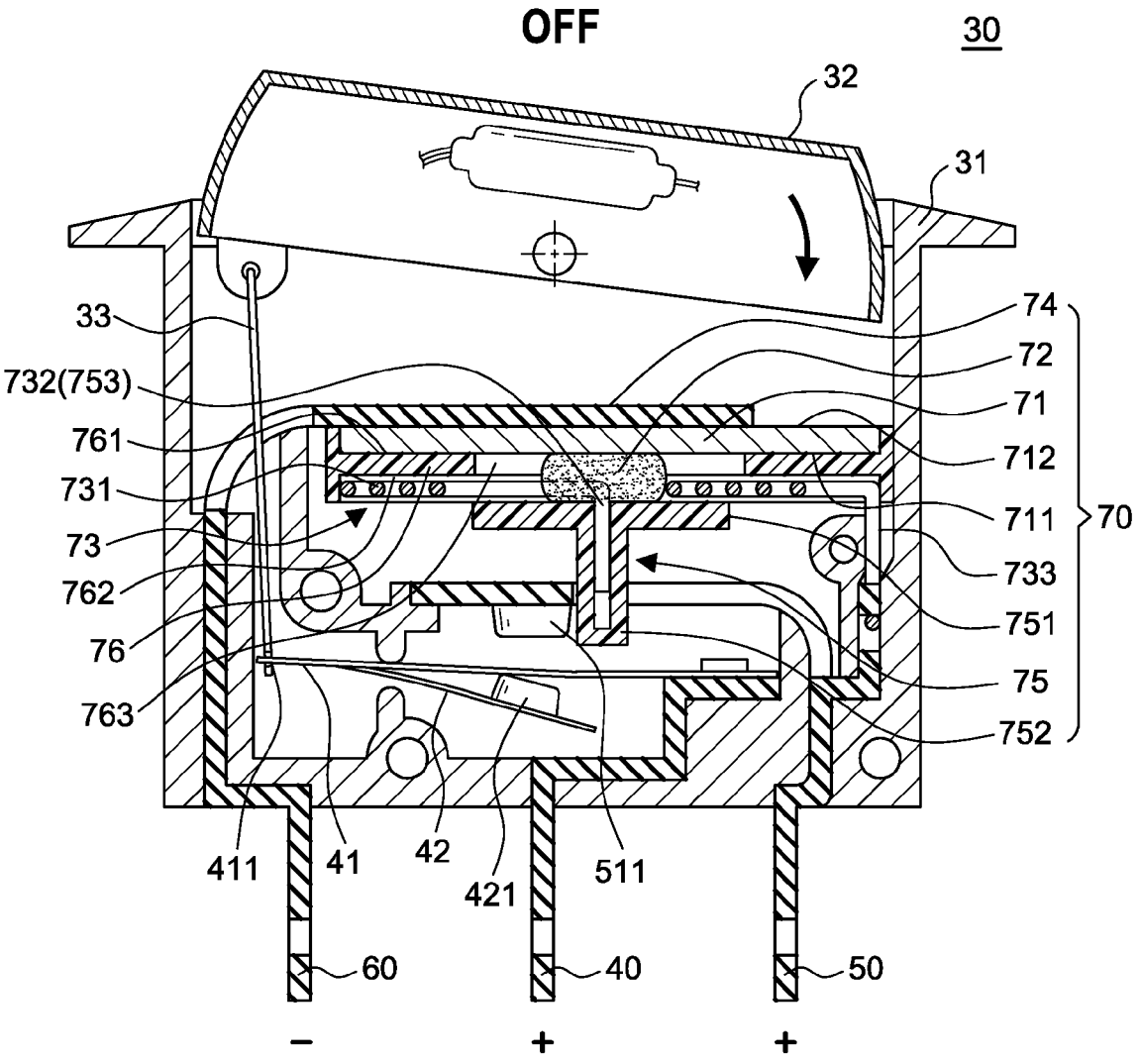
FIG. 3 is a sectional view of the present invention in a first embodiment in an OFF status.
Figure 4:
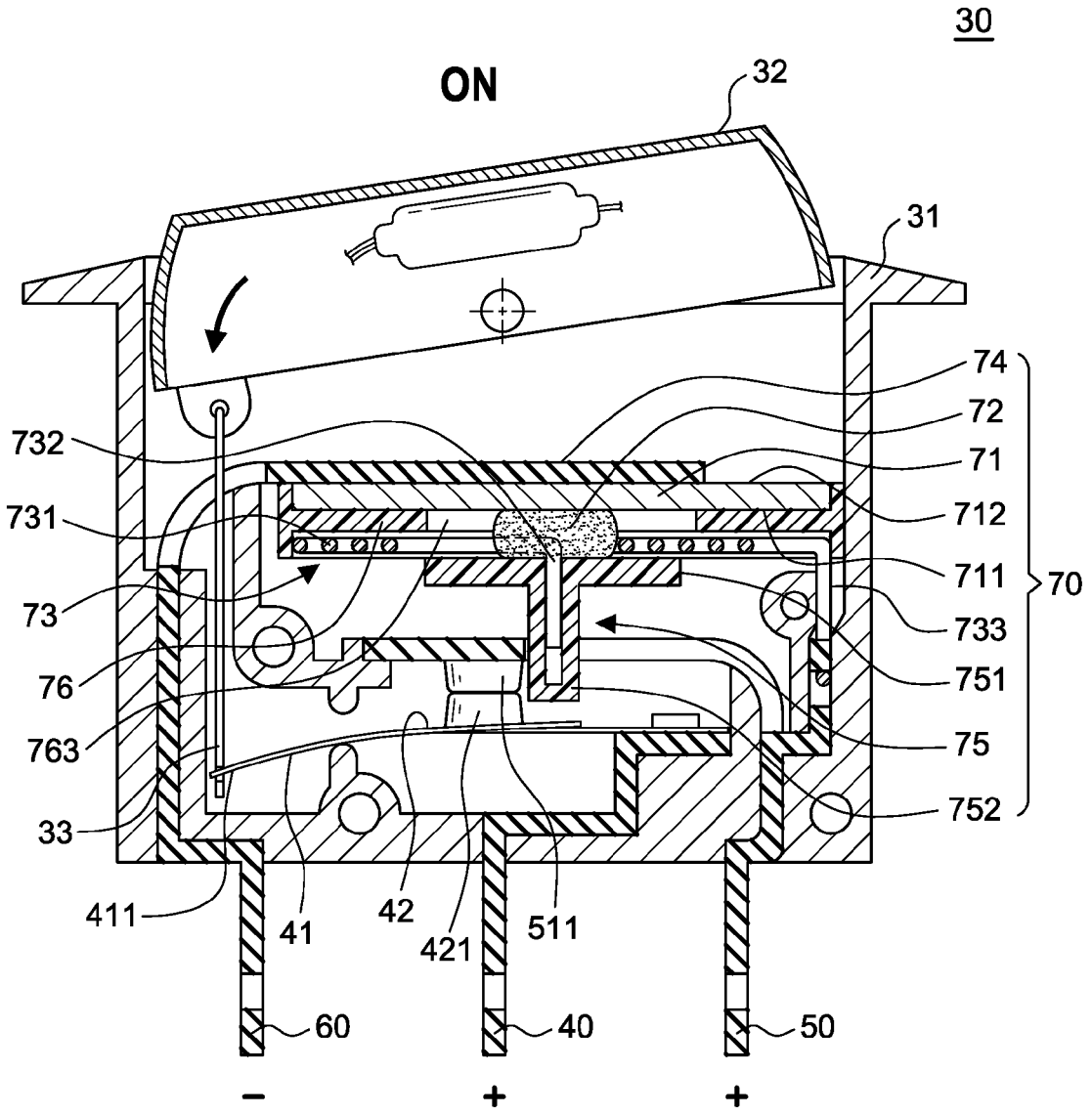
FIG. 4 is a sectional view of the present invention in the first embodiment in an ON status.

The moving rod 33 has a top end arranged at the bottom of the press button 32 and a bottom end connecting to a movable end 411 of the binary alloy conductive plate 41. With reference to FIG. 4, when pressing the press button 32, the binary alloy conductive plate 41 ejects upwards and the spring leaf 42 ejects downwards to make the first connecting point 421 contacting the second connecting point 511 and thus turn on the switch; when current overload occurs, the binary alloy conductive plate 41 deforms due to high temperature and detach the first connecting point 421 from the second connecting point 511 to turn the switch off back to the original status as shown in FIG. 3, so as to form a switch module 30 with an overcurrent protection switch.

The arrangement of the binary alloy conductive plate 41 and the press button 32 is different in various switch modules. In this embodiment, the binary alloy conductive plate 41 has the first connecting point 421 arranged on the spring leaf 42 but it is not limited to such application. The binary alloy conductive plate 41 can eject without the spring leaf 42 and the first connecting point 421 can be arranged aside the binary alloy conductive plate 41. Also, theis is a positive electrode for output and a negative electrode for input; in the embodiment, the first conductive plate 40 is arranged to be the positive electrode input and the second conductive plate 50 is arranged to be the positive electrode output.

The features of the present invention lies in that the anti-surge disconnection structure 70 is built inside the housing 31 and includes at least one metal oxide varistor 71, at least one insulating element 76, at least one conductive spring element 73, at least one thermo-sensitive piece 72, and at least one pushing element 75.

The metal oxide varistor 71 is disposed under a plate 74 and has a first surface 711 and an opposite second surface 712. In this embodiment, the first surface 711 is the positive electrode and the second surface 712 is the negative electrode; they are electrically connected to the second conductive plate 50 and the third conductive plate 60 by a connector which can be a conductive wire, a conductive plate, or a conductive element extended from the surface of the metal oxide varistor 71.

The insulating element 76 has a through hole 763 arranged at a center thereof, an upper surface 761 and a lower surface 762. The upper surface 761 is arranged correspondingly to the first surface 711 of the metal oxide varistor 71 to ensure melting liquid would not spill out. Size of the through hole 763 and positions of insulation and adherence on the insulting element 76 is adaptable according to different needs. In this embodiment, the insulating element 76 is arranged in a shape in correspondence to the shape of the metal oxide varistor 71, and it has a surrounding protrusion 764 on both the upper surface 761 and the lower surface 762, individually forming a space thereon.

Figure 6:
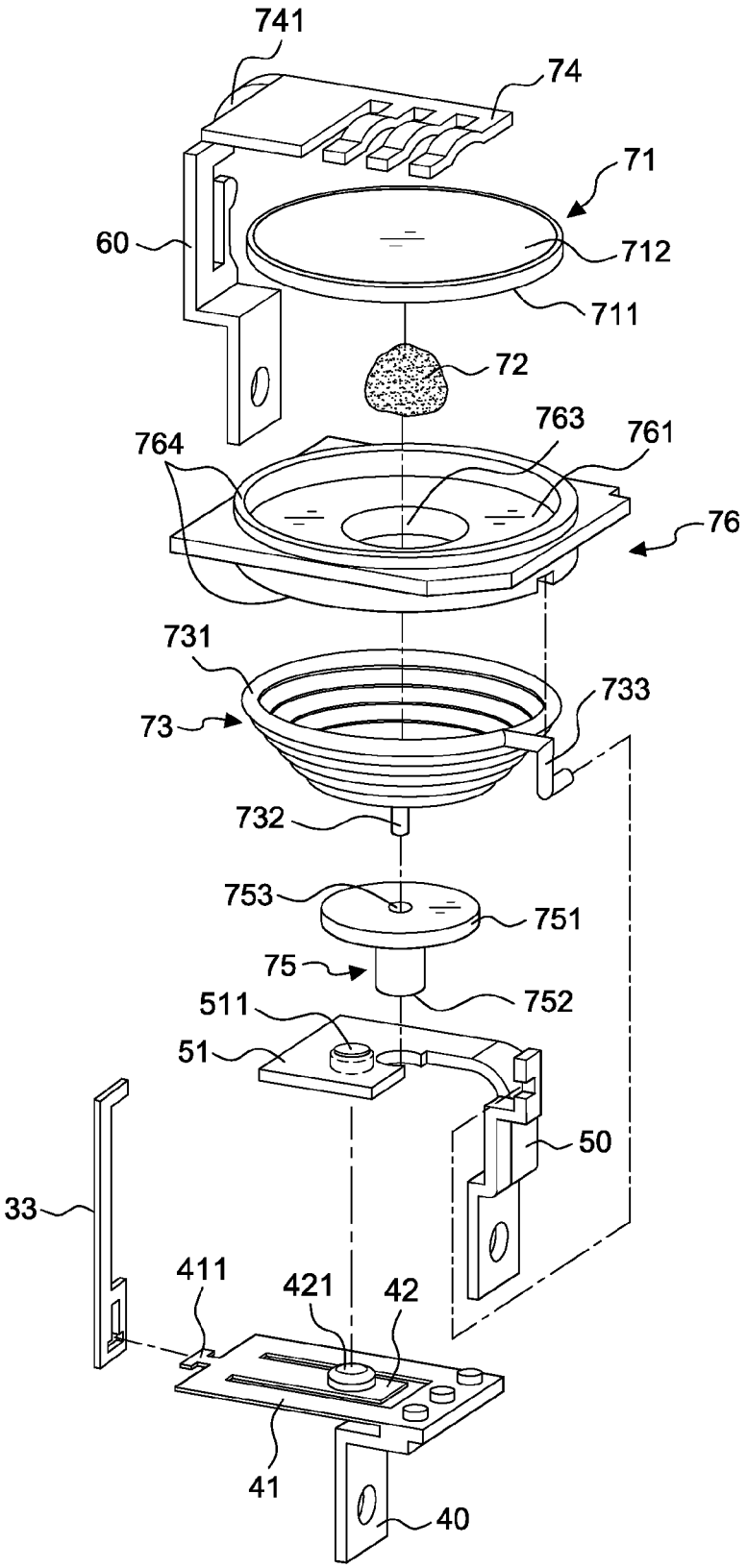
FIG. 6 is an exploded view of major components of the present invention in the first embodiment.
Figure 6A:
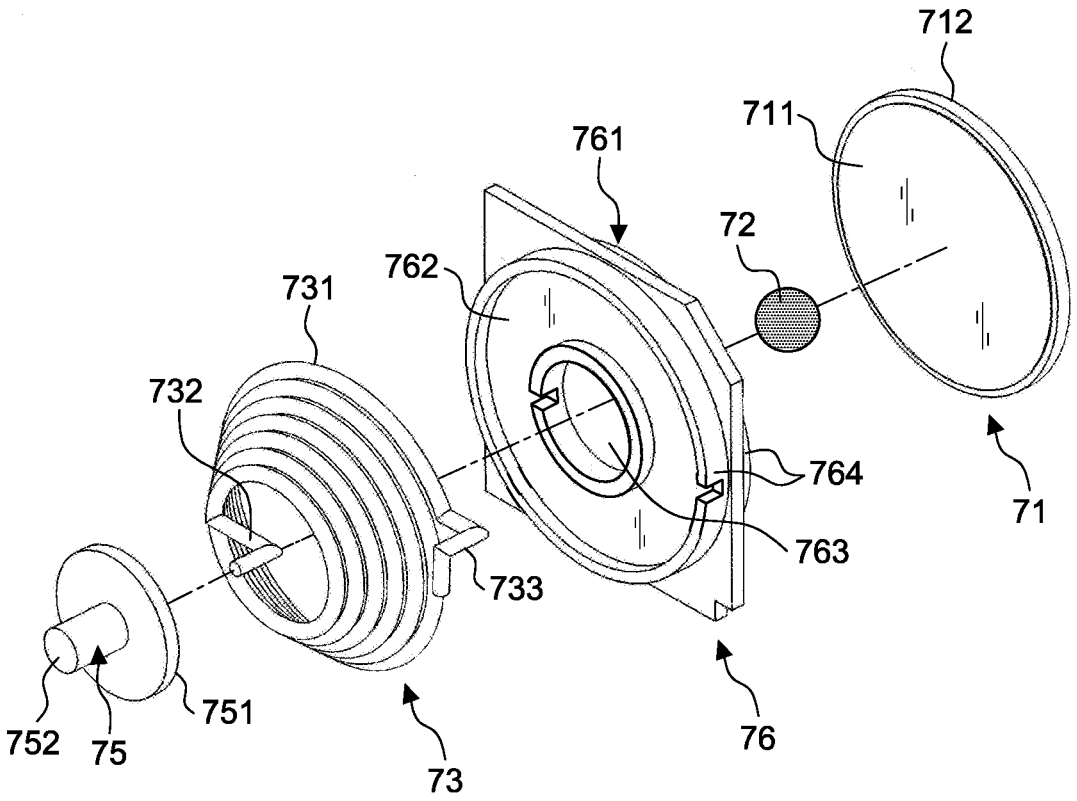
FIG. 6A is an exploded view of partial components of the present invention in the first embodiment.

The conductive spring element 73 has an outer periphery 731 and a springy section 732 compressed in the through hole 763 of the insulating element 76 on the first surface 711 of the metal oxide varistor 71. In this embodiment, there is one spring element 73 and one metal oxide varistor 71. The second surface 712 of the metal oxide varistor 71 is arranged under the plate 74 which is arranged to have a fixed surface for ejection; therefore, it can be a conductive plate, a positioning plate formed in one-piece together with the housing 31, or an extended portion from the third conductive plate 60. The spring element 73 is abutting on the lower surface 762 of the insulating element 76 and the outer periphery 731 of the spring element 73 further has an extended portion 733 that is arranged as a bended portion 734 and connects the first surface 711 of the metal oxide varistor 71 with the second conductive plate 50. As shown in FIG. 6, the second surface 712 of the metal oxide varistor 71 is connected to the third conductive plate 60 by the plate 74 and a conductive wire 741; in this embodiment, the plate 74 and conductive wire 741 are formed in one-piece extended from the third conductive plate 60 and the extended portion 733, the outer periphery 731 and the springy section 732 of the spring element 73 are formed in one-piece.

The thermo-sensitive piece 72 is conductive and solid colloid to be disposed in the through hole 763 of the insulating element 76 for the springy section 732 of the spring element 73 to be adhered between the lower surface 762 of the insulating element 76 and the first surface 711 of the metal oxide varistor 71 for electrical connection and for the spring element 73 to be ready for ejection. In this embodiment, the thermos-sensitive piece 72 is made of metal compounds which are conductive and fast-acting in low temperature that would melt at a pre-determined degree before temperature of the metal oxide varistor 71 rises up to a dangerously high number.

The pushing element 75 has a first end 751 arranged correspondingly to the metal oxide varistor 71, the insulating element 76 and the springy section 732 of the spring element 73, and a second end 752 arranged correspondingly to the binary alloy conductive plate 41 for pushing.

In this embodiment, the pushing element 75 is an isolated pushing rod and the first end 751 thereof is contacting the springy section 732 of the spring element 73, and the second end 752 thereof is arranged as a protruding portion to contact the binary alloy conductive plate 41. Furthermore, the first end 751 is arranged in a shape in accordance with shapes of the insulating element 76 and the spring element 73, and it has a positioning hole 753 for the springy section 732 of the spring element 73 to engage therein; whereby the first connecting point 421 on the binary alloy conductive plate 41 would be forced to detach from the second connecting point 511 when the spring element 73 is ejected.

Figure 5:
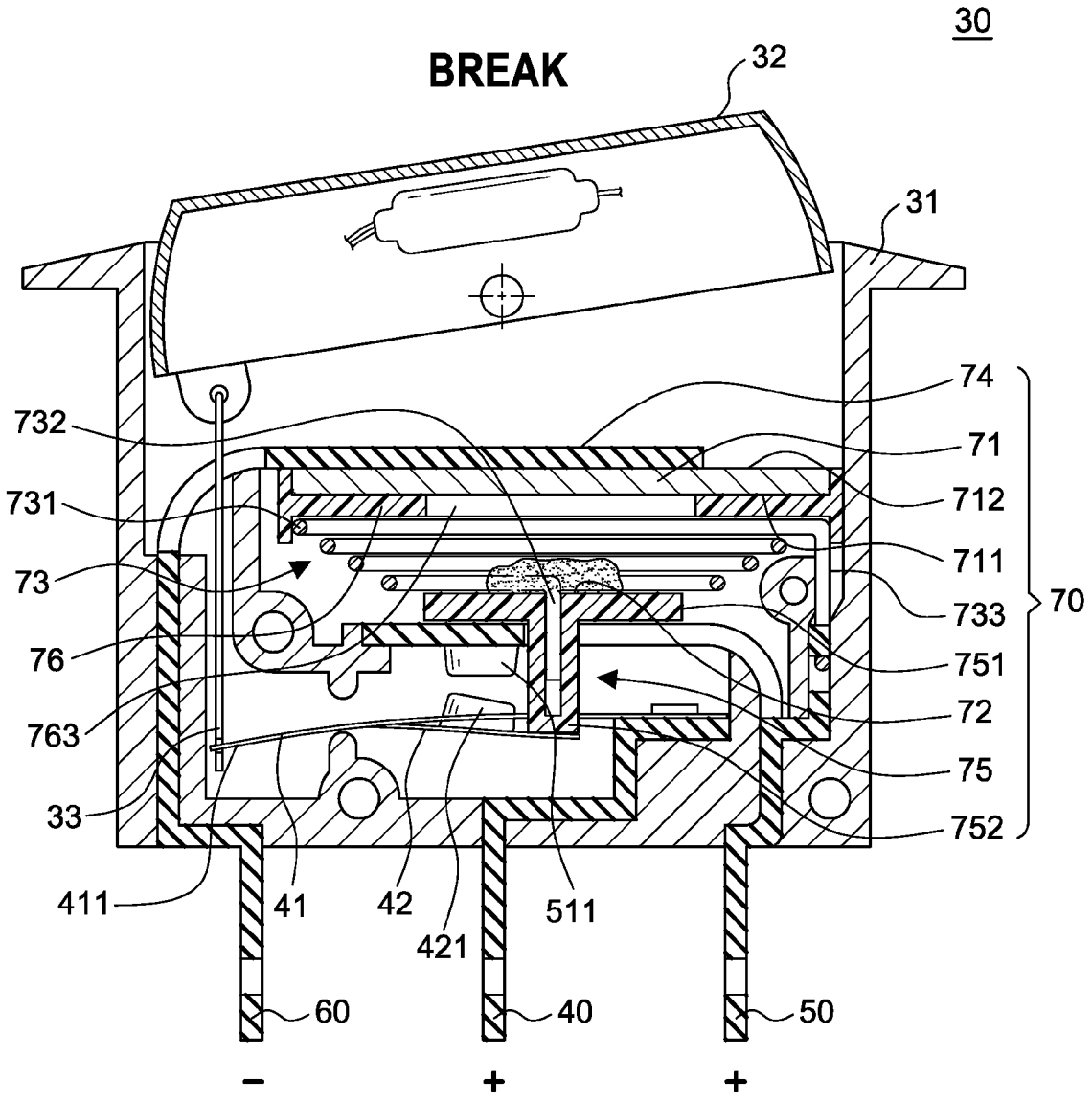
FIG. 5 is an application example of the present invention in the first embodiment, illustrating the thermo-sensitive piece melting, loosening the spring element, displacing the pushing element and further turning the switch off.

Further referring to FIG. 5, when the first connecting point 421 is contacting the second connecting point 511 and overvoltage occurs, temperature of the metal oxide varistor 71 would instantly rise up to a degree higher than melting point of the thermo-sensitive piece 72, melting the thermo-sensitive piece 72, counterbalancing the compressing force on the spring element 73 and further displacing the pushing element 75, therefore forcing the first connecting point 421 detaching from the second connecting point 511 for disconnection and turning off the switch without causing the first conductive plate 40 deformed due to high degree of temperature; meanwhile, the insulating element 76 further ensures the disconnection of the metal oxide varistor 71 from the spring element 73 by insulation. The metal oxide varistor 71 stops heating up and supplying electricity power for the device due to the disconnection as a result.

Figure 7:
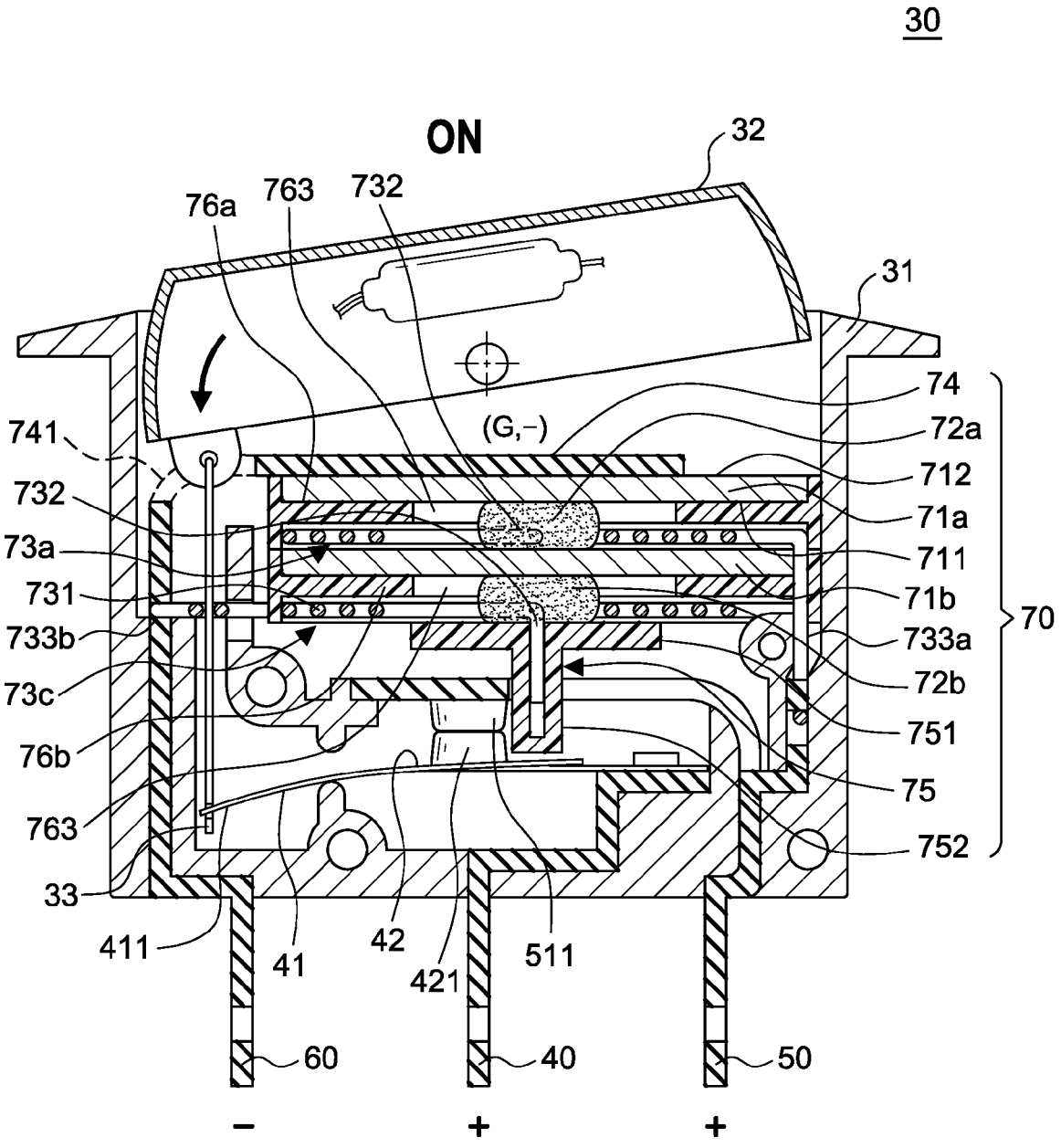
FIG. 7 is a sectional view of the present invention in a second embodiment with two metal dioxide varistors.
Figure 8:
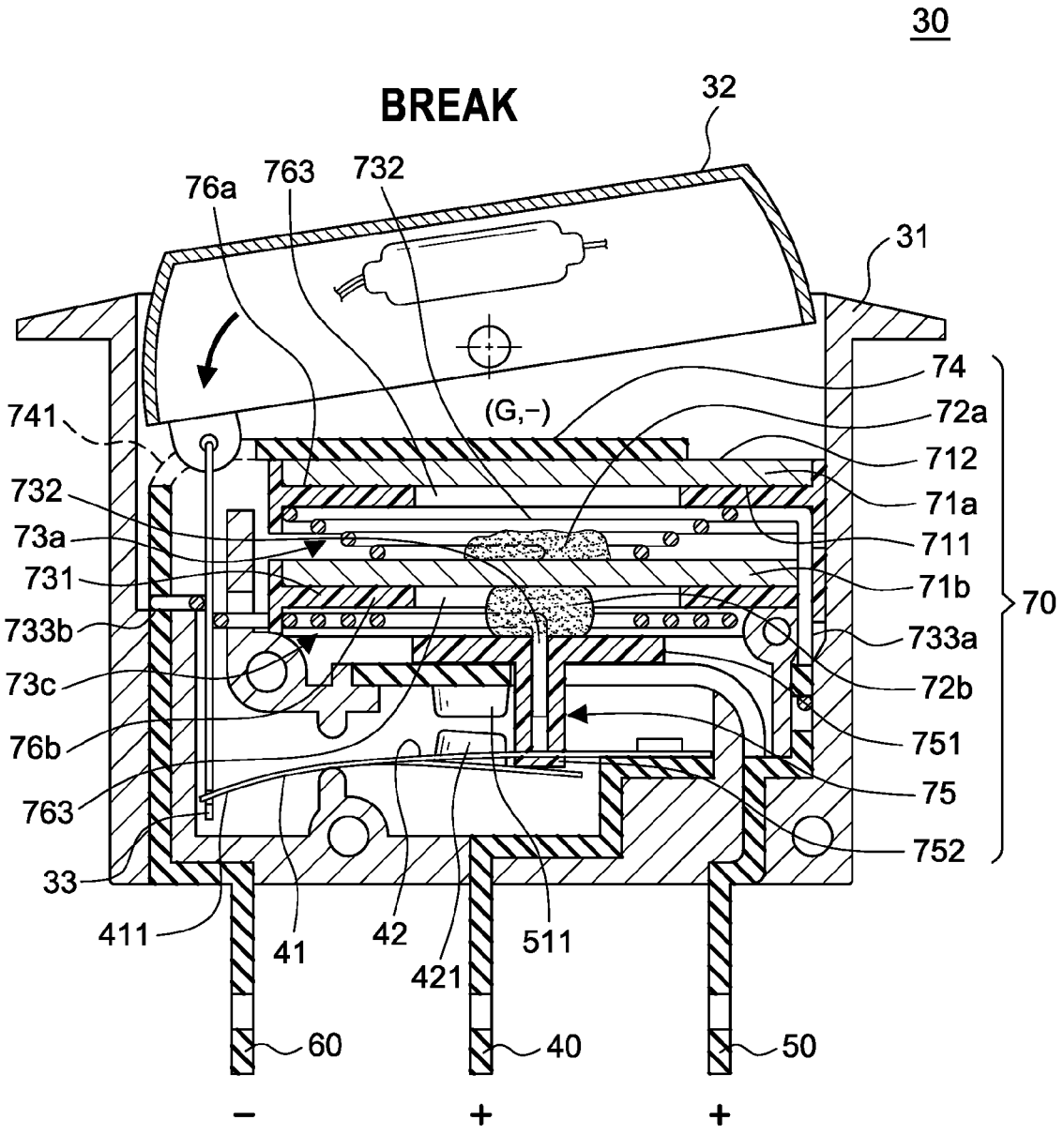
FIG. 8 is another sectional view of FIG. 7, illustrating the thermo-sensitive piece melting, loosening the spring element, displacing the pushing element and further turning the switch off.
Figure 9:
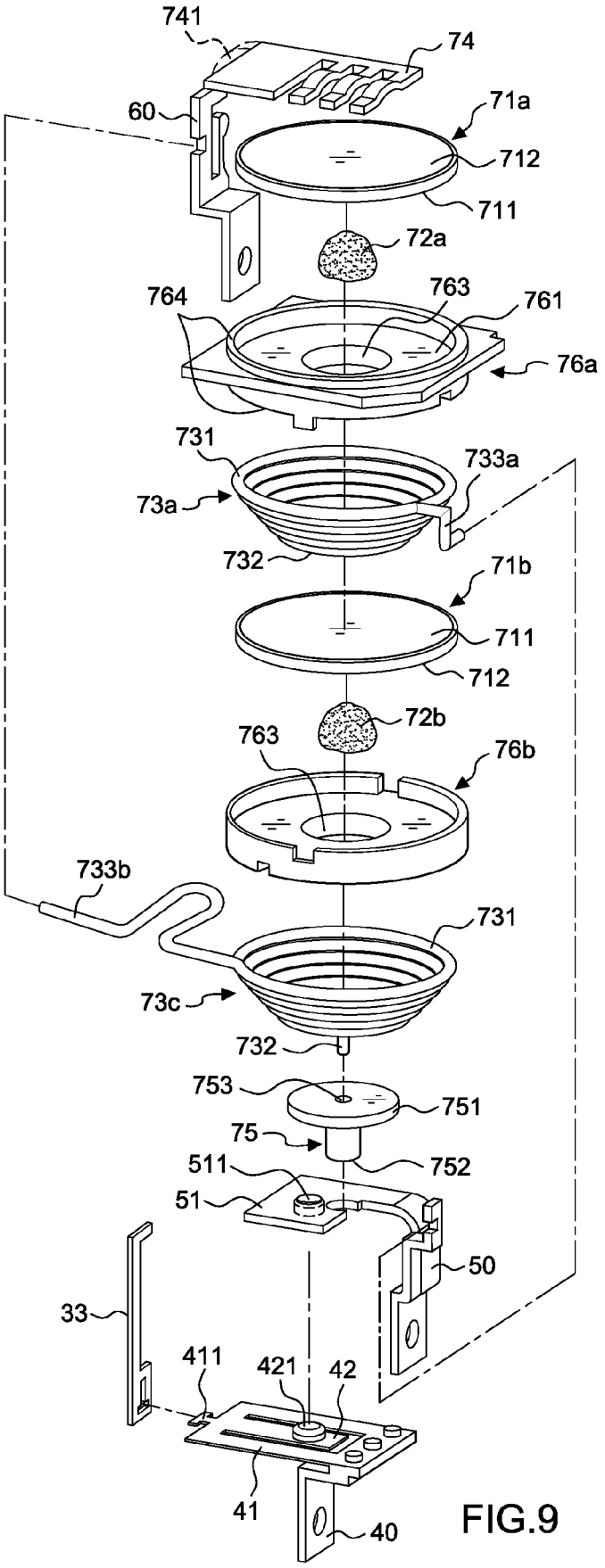
FIG. 9 is an exploded view of major components of the present invention in the second embodiment.

FIGS. 7-9 illustrate elements of the present invention in a second embodiment. In this embodiment, the anti-surge disconnection structure 70 mainly comprises a first metal oxide varistor 71*a*, a second metal oxide varistor 71*b*, a first thermo-sensitive piece 72*a*, a second thermo-sensitive piece 72*b*, a first insulating element 76*a*, a second insulating element 76*b*, a conductive spring element 73*a*, an electrical connector 73*c*, and a pushing element 75.

The first metal oxide varistor 71*a* is disposed under a plate 74 and has a first surface 711 and an opposite second surface 712. The first insulating element 76*a* has a through hole 763 arranged at a center thereof, an upper surface 761 and a lower surface 762. The spring element 73*a* has an a springy section 732 compressed in the through hole 763 by the first surface 711 of the first metal oxide varistor 71*a* and an outer periphery 731 having a first extended portion 733*a* connecting to the first surface 711 of the first metal oxide varistor 73*a* with the second conductive plate 50. The first thermo-sensitive piece 72*a* is conductive and solid colloid to be disposed in the through hole 763 of the first insulating element 76*a* for the springy section 732 of the spring element 73 to be compressed and adhered between the lower surface 762 of the first insulating element 76*a* and the first surface 711 of the first metal oxide varistor 71*a* for electrical connection, and the spring element 73*a* to be ready for ejection.

The second metal oxide varistors 71*b* also has a first surface 711 compressing the spring element 73*a*. The second insulating element 76*b* has a through hole 763 arranged at a center thereof, an upper surface 761 and a lower surface 762. The electrical connector 73*c* is disposed under the second insulating element 76*b* and a second surface 712 of the second metal oxide varistor 71*b* with a second extended portion 733*b* arranged aside for electrical connection between the second surface 712 of the second metal oxide varistor 71*b* and the third conductive plate 60. In this embodiment, the first extended portion 733*a* and the second extended portion 733*b* are arranged as bended portions for respectively engaging the second conductive plate 50 and the third conductive plate 60. The second thermo-sensitive piece 72*b* is conductive and solid colloid to be disposed in the through hole 763 of the second insulating element 76*b*, electrically connecting the springy section 732 of the electrical connector 73*c* and the second surface 712 of the second metal oxide varistor 71*b*; and the springy section 732 of the electrical connector 73*c* is compressed and adhered on the second surface 712 of the second metal oxide varistor 71*b* for the electrical connector 73*c* to be ready for ejection.

The pushing element 75 has a first end 751 arranged correspondingly under the second surface 712 of the second metal oxide varistor 71*b*, the second insulating element 76*b* and the electrical connector 73*c*, and a second end 752 arranged correspondingly to the binary alloy conductive plate 41 for pushing. In this embodiment, the electric connector 73*c* is made of a spring and has an outer periphery 731 and a springy section 732 compressed by the second surface 712 of the second metal oxide varistor 71*b* corresponding to the through hole 763 of the second insulating element 76*b*. The second end 752 of the pushing element 75 is arranged close to the binary alloy conductive plate 41 so that when either of the first spring element 73*a* or the electrical connector 73*c* ejects the pushing element 75 would displace and force the first contacting point 421 on the binary alloy conductive plate 41 detaching from the second contacting point 422 and therefore stop the heating operation of the first and second metal oxide varistors 71*a*, 71*b* to cease the power supply operation.

FIG. 8 is a schematic diagram illustrating the first thermo-sensitive piece 72*a* melting, loosening the spring element 73*a*, displacing the pushing element 75, and further turning the switch off. In this embodiment, the plate 74 does not have to be parallel connected to the third conductive plate 60; it is also applicable to connect the second extended portion 733*b* with the third conductive plate 60 and to have the plate 74 being the ground for connection. In the embodiment, the melting of either of the thermo-sensitive pieces 72*a*, 72*b* would cause ejection of either the spring element 73*a* or the electrical connector 73*c* and disconnect the device without damaging structure of the other thermo-sensitive piece for disconnection.

Figure 10:
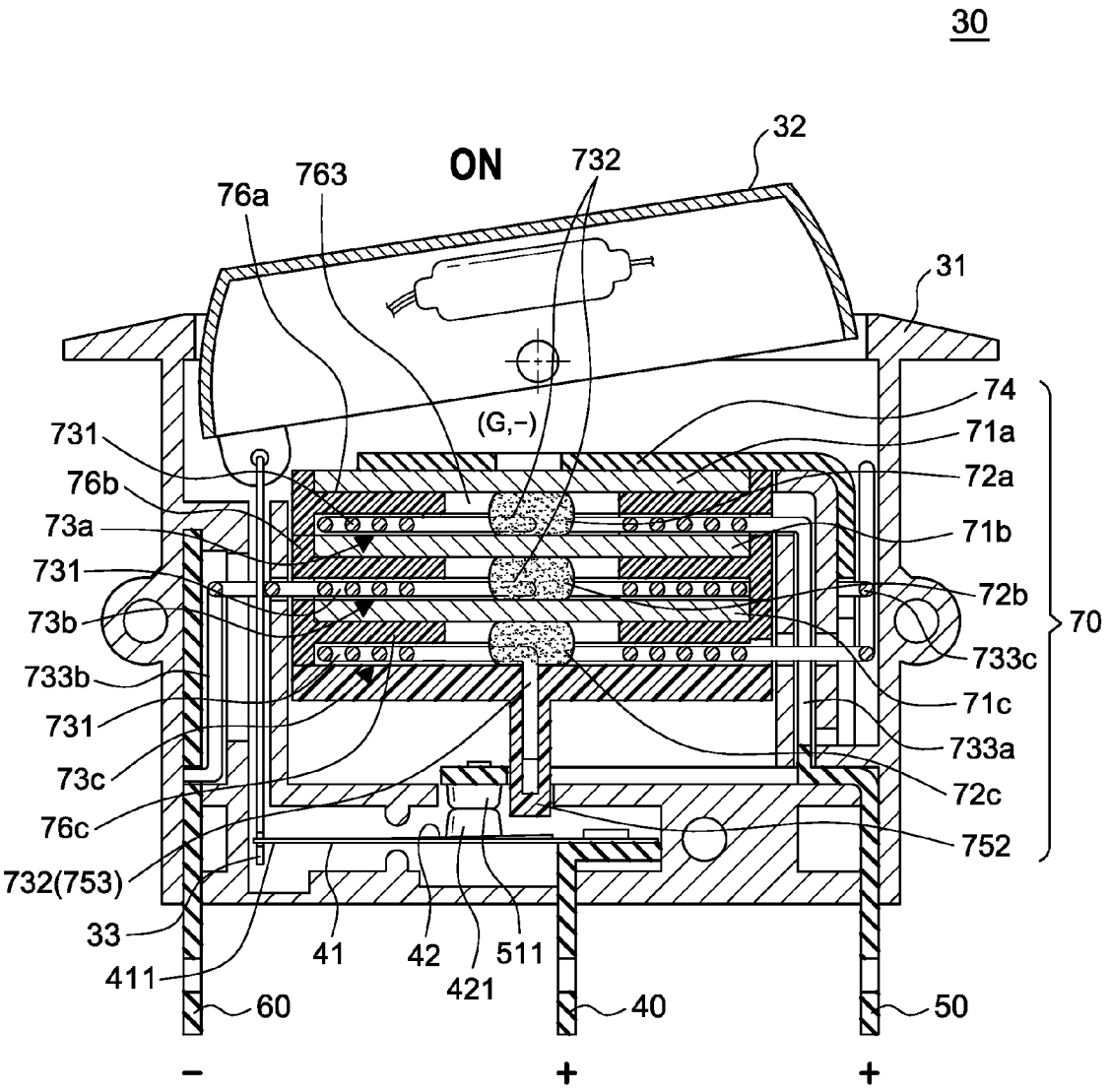
FIG. 10 a sectional view of the present invention in a third embodiment with three metal oxide varistors.
Figure 11:
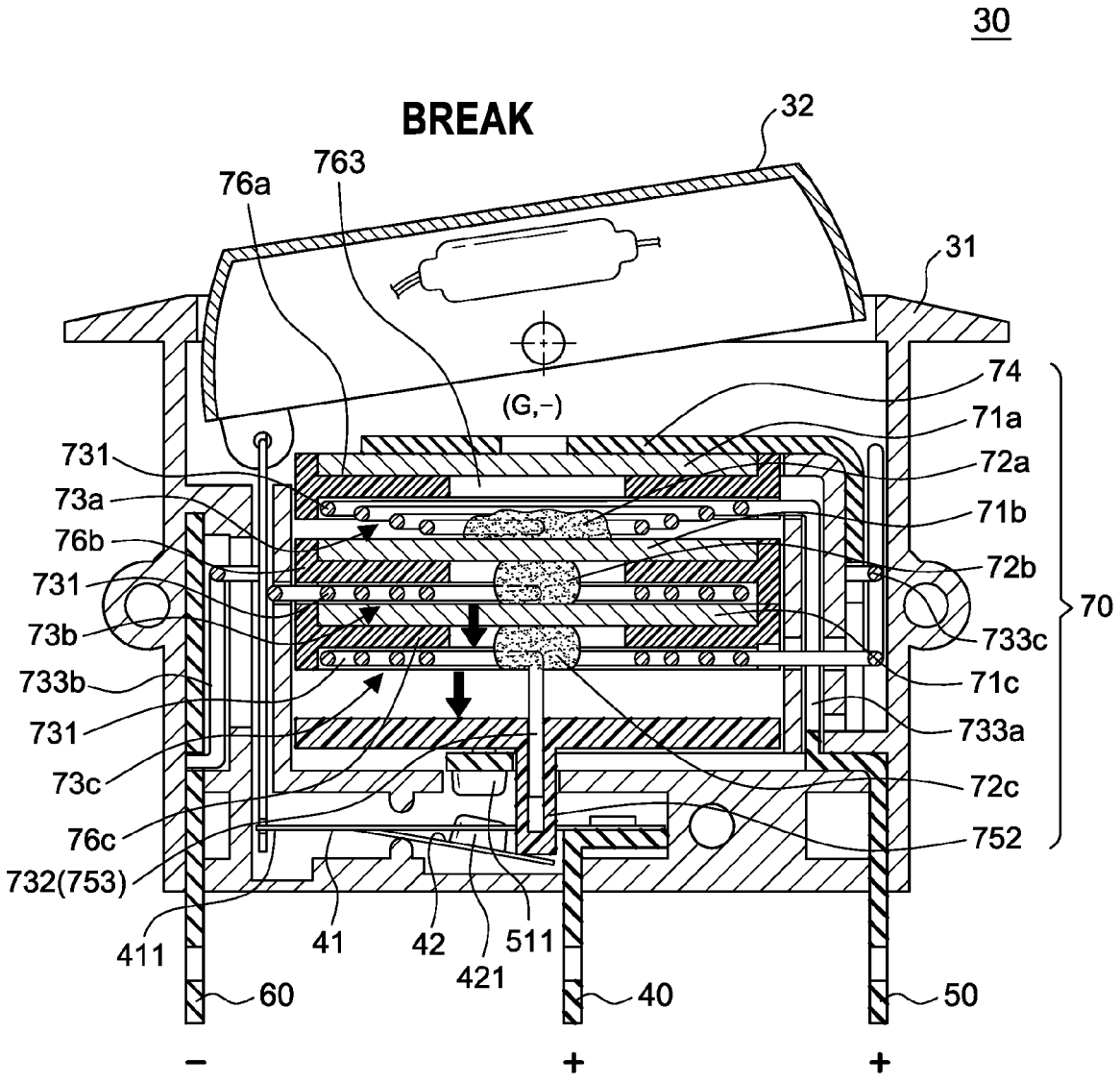
FIG. 11 is another sectional view of FIG. 10, illustrating the thermo-sensitive pieces melting, loosening the spring element, displacing the pushing element, and further turning the switch off.
Figure 12:
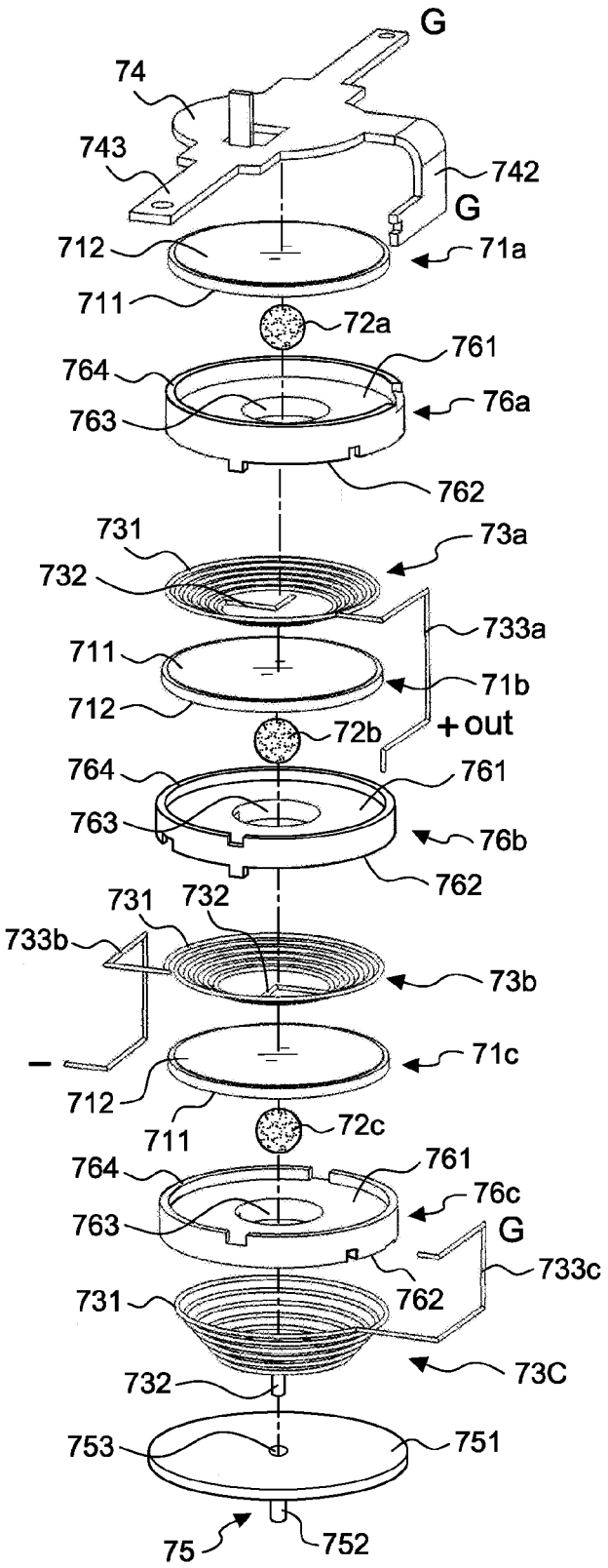
FIG. 12 is an exploded view of major components of the present invention in the third embodiment.
Figure 13:
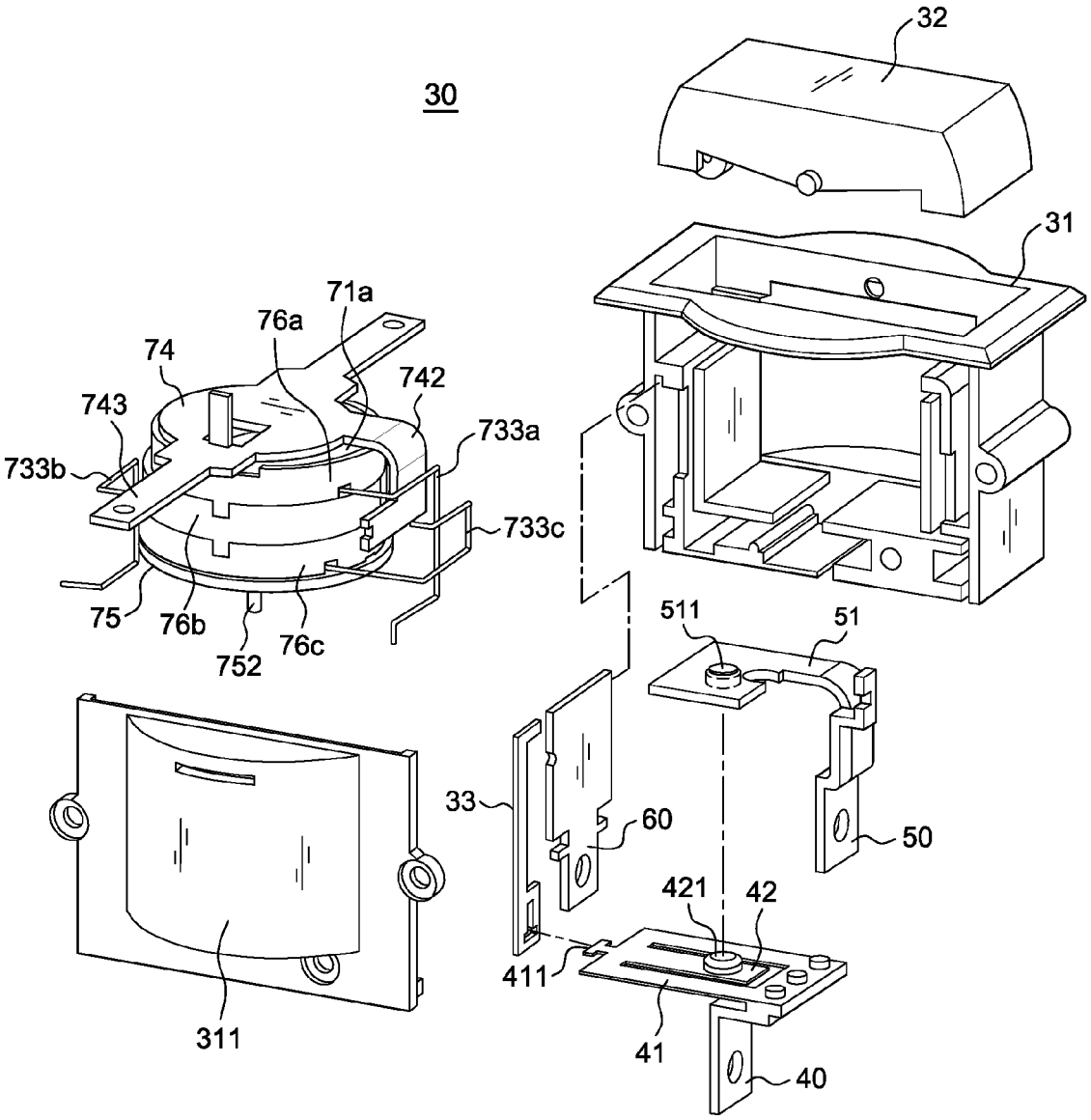
FIG. 13 is an exploded view of the present invention in the third embodiment.

FIGS. 10-12 illustrate a third embodiment of the present invention. In this embodiment, the anti-surge disconnection structure 70 mainly comprises a first metal oxide varistor 71*a*, a second metal oxide varistor 71*b*, a third metal oxide varistor 71*c*, a first thermo-sensitive piece 72*a*, a second thermo-sensitive piece 72*b*, a third thermo-sensitive piece 72*c*, a first insulating element 76*a*, a second insulating element 76*b*, a third insulating element 76*c*, a first spring element 73*a*, a second spring element 73*b*, an electrical connector 73*c* and a pushing element 75.

The first insulating element 76*a* has a through hole 763 arranged at a center thereof, an upper surface 761 and a lower surface 762. The upper surface 761 is arranged correspondingly to the first surface 711 of the first metal oxide varistor 71*a*. The first thermo-sensitive piece 72*a* is conductive and solid colloid to be disposed in the through hole 763 of the first insulating element 76*a* for a springy section 732 of the first spring element 73*a* to be compressed and adhered between the lower surface 762 of the first insulating element 76*a* and the first surface 711 of the first metal oxide varistor 71*a* for electrical connection and for the first spring element 73*a* to be ready for ejection. The first spring element 73*a* further has an outer periphery 731 with a first extended portion 733*a* connecting the first surface 711 of the first metal oxide varistor 71*a* with the second conductive plate 50.

The second insulating element 76*b* has a through hole 763 arranged at a center thereof, an upper surface 761 and a lower surface 762; the upper surface 761 is arranged correspondingly to the second surface 712 of the second metal oxide varistor 71*b*. The second metal oxide varistor 71*b* has a first surface 711 and an opposite second surface 712; the first surface 711 thereof is compressing the first spring element 73*a*. The second thermo-sensitive piece 72*b* is conductive and solid colloid to be disposed in the through hole 763 of the second insulating element 76*b* for a springy section 732 of the second spring element 73*b* to be compressed and adhered between the lower surface 762 of the second insulating element 76*b* and the second surface 712 of the second metal oxide varistor 71*b* for electrical connection and for the second spring element 73*b* to be ready for ejection. The second spring element 73*b* further has an outer periphery 731 with a second extended portion 733*b* connecting the second surface 712 of the second metal oxide varistor 71*b* with the third conductive plate 60.

The third insulating element 76*c* has a through hole 763 arranged at a center thereof, an upper surface 761 and a lower surface 762; the upper surface 761 is arranged correspondingly to the first surface 711 of the third metal oxide varistor 71*c*. The electrical connector 73*c* abuts on the third insulating element 76*c* and has an outer periphery 731 with a third extended portion 733*c* electrically connecting to the first surface 711 of the third metal oxide varistor 71*c* and to the plate 74. The plate 74 is also electrically connected to the second surface 712 of the first metal oxide varistor 71*a*.

The third metal oxide varistor 72*c* is conductive and solid colloid to be disposed in the through hole 763 of the third insulating element 76*c* for a springy section 732 of the electrical connector 73*c* to be electrically connected to the first surface 711 of the third metal oxide varistor 71*c* and to be compressed and adhered between the lower surface 762 of the third insulating element 76*c* and the first surface 711 of the third metal oxide varistor 71*c* for electrical connection and for the electrical connector 73*c* to be ready for ejection.

The pushing element 75 has a first end 751 disposed under the electrical connector 73*c* and arranged correspondingly to a middle of the electrical connector 73*c* and the first surface 711 of the third metal oxide varistor 71*c*, and a second end 752 arranged correspondingly to the binary alloy conductive plate 41 for pushing. In the embodiment, the melting of either of the thermo-sensitive pieces 72*a*, 72*b* would cause ejection of either of the first or second spring elements 73*a*, 73*b* and disconnect the device without damaging structure of other thermo-sensitive pieces for disconnection.

Figure 14:
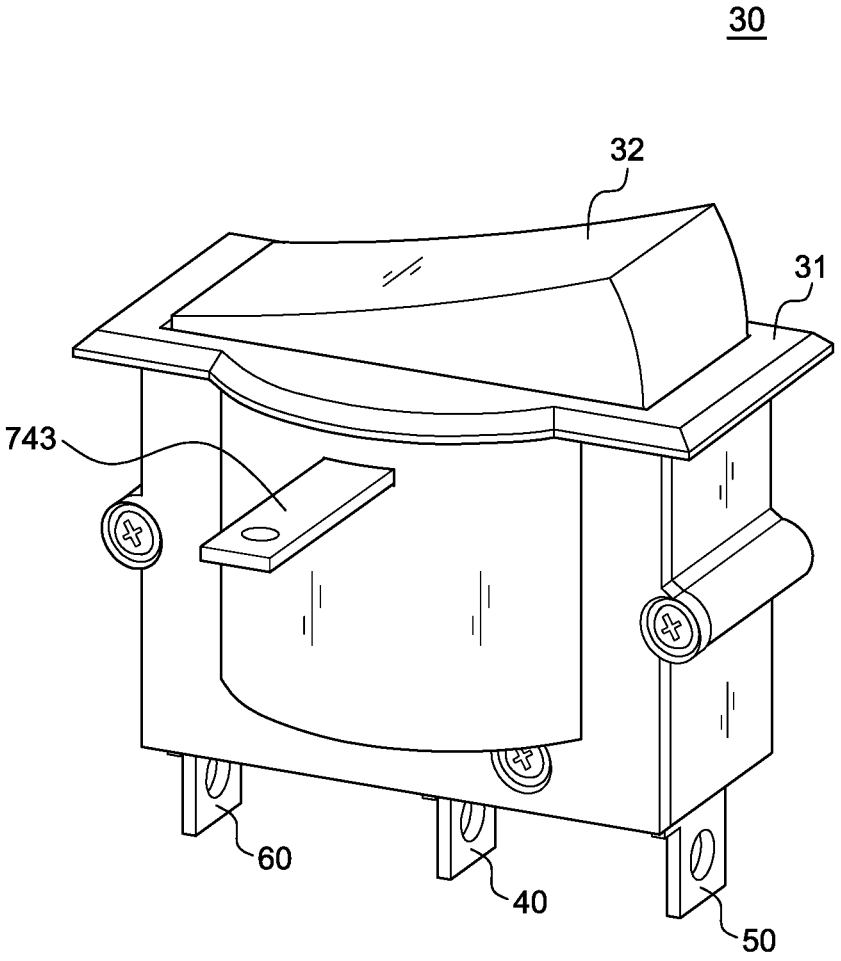
FIG. 14 is a perspective view of FIG. 13.

In this embodiment, the electrical connector 73*c* is made of a spring that has an outer periphery 731 with a third extended portion 733*c* electrically connecting to the third metal oxide varistor 71*c*, and a springy section 732 compressed under the third insulating element 76*c* and the first surface 711 of the third metal oxide varistor 71*c*; the plate 74 further has a conductive element 742 to be electrically connected to the third extended portion 733*c* of the electrical connector 73*c* and a fourth conductive plate 743 disposed aside and extended to outside of the housing 31 as shown in FIG. 14.

With structures disclosed above, the present invention complements the defect of a conventional overcurrent protection switch that it has to connect to a metal oxide varistor and a thermal fuse from the outside by having an anti-surge disconnection structure 70 including at least one metal oxide varistor, at least one thermo-sensitive pieces, at least one insulating element, and at least one conductive spring element ingeniously built inside so that when receiving exceedingly high voltages, the heating metal oxide varistor would instantly melt at least one thermo-sensitive piece, counterbalancing the compressing force on a spring element and further displacing the pushing element, therefore forcing the connecting points to detach and turning off the switch immediately; meanwhile, a corresponding insulating element would further ensure the disconnection is performed completely and safely. Hence, the present invention has the original function of overcurrent protection and further has the overvoltage protection and anti-surge disconnection structures built inside, ensuring more electricity safety and conveniences in using.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A switch module with a built-in structure of anti-surge and dual disconnection, comprising:

a housing having a press button arranged atop thereof, and a first conductive plate, a second conductive plate and a third conductive plate arranged at a lower section thereof; said first conductive plate being connected to a binary alloy conductive plate having a first connecting point, and the second conductive plate having a second connecting point on the surface of an upper section thereof corresponding to the first connecting point;

a moving rod linking up the bottom of the press button with one end and the binary alloy conductive plate with the other end for the first connecting point to contact the second connecting point, consequently turning on the switch, and for the first connecting point to detach from the second connecting point when current overload occurs and the binary alloy conductive plate is deformed due to high temperature, consequently turning off the switch, so as to form an overcurrent protection switch;

wherein a structure of anti-surge and dual disconnection is built inside the housing, including:

at least one metal oxide varistor being disposed under a plate and having a first surface and an opposite second surface;

at least one insulating element having a through hole arranged at a center thereof, an upper surface and a lower surface, said upper surface arranged correspondingly to the first surface of the metal oxide varistor;

at least one conductive spring element having an outer periphery with an extended portion connecting the first surface of the metal oxide varistor with the second conductive plate, and a springy section being compressed by the first surface of the metal oxide varistor in the through hole of the insulating element;

at least one thermo-sensitive piece which is conductive and solid colloid to be disposed in the through hole of the insulating element for the springy section of the spring element to be adhered between the lower surface of the insulating element and the first surface of the metal oxide varistor for electrical connection and for the spring element to be ready for ejection; and a pushing element having a first end thereof arranged correspondingly to the metal oxide varistor, the insulating element and the springy section of the spring element, and a second end thereof arranged correspondingly to the binary alloy conductive plate for pushing;

whereby when the first connecting point is contacting the second connecting point and an overvoltage occurs, temperature of the metal oxide varistor would instantly rise up to a degree higher than the melting point thereof, therefore melting the thermo-sensitive piece, loosening the springy section of the spring element and displacing the pushing element to force the first connecting point detaching from the second connecting point and turn off the switch; meanwhile, the insulating element also disconnects the circuit structure simultaneously.

2. The switch module with a built-in structure of anti-surge and dual disconnection as claimed in claim 1, wherein the pushing element has the second end arranged as a protruding portion and the first end including a positioning hole for the springy section of the spring element to engage therein, and the first end is arranged in a shape in accordance with shapes of the insulating element and the spring element.

3. The switch module with a built-in structure of anti-surge and dual disconnection as claimed in claim 1, wherein the second surface of the metal oxide varistor is connected to the third conductive plate by the plate and a conductive wire, and the plate and the conductive wire are formed in one-piece with the third conductive plate.

4. The switch module with a built-in structure of anti-surge and dual disconnection as claimed in claim 1, wherein the insulating element is arranged in a shape in correspondence to the shape of the metal oxide varistor and it has a surrounding protrusion on both the upper surface and the lower surface, individually forming a space thereon.

5. A switch module with a built-in structure of anti-surge and dual disconnection, comprising:

a housing having a press button arranged atop thereof, and a first conductive plate, a second conductive plate and a third conductive plate arranged at a lower section thereof; said first conductive plate being connected to a binary alloy conductive plate having a first connecting point, and the second conductive plate having a second connecting point on the surface of an upper section thereof corresponding to the first connecting point;

a moving rod linking up the bottom of the press button with one end and the binary alloy conductive plate with the other end for the first connecting point to contact the second connecting point, consequently turning on the switch, and for the first connecting point to detach from the second connecting point when current overload occurs and the binary alloy conductive plate is deformed due to high temperature, consequently turning off the switch, so as to form an overcurrent protection switch;

wherein a structure of anti-surge and dual disconnection is built inside the housing, including:

a first metal oxide varistor being disposed under a plate and having a first surface and an opposite second surface;

a first insulating element having a through hole arranged at a center thereof, an upper surface and a lower surface, said upper surface arranged correspondingly to the first surface of the first metal oxide varistor;

at least one conductive spring element having an outer periphery with a first extended portion connecting the first surface of the first metal oxide varistor with the second conductive plate, and a springy section being compressed in the through hole of the first insulating element by the first surface of the first metal oxide varistor;

a first thermo-sensitive piece which is conductive and solid colloid to be disposed in the through hole of the first insulating element for the springy section of the spring element to be compressed and adhered between the lower surface of the first insulating element and the first surface of the first metal oxide varistor for electrical connection and for the spring element to be ready for ejection;

a second metal oxide varistor having a first surface and an opposite second surface; said first surface compressing the spring element;

a second insulating element having a through hole arranged at a center thereof, an upper surface and a lower surface, said upper surface arranged correspondingly to the second surface of the second metal oxide varistor;

an electrical connector having an outer periphery with a second extended portion electrically connecting the second surface of the second metal oxide varistor with the third conductive plate, and a springy section being compressed by the lower surface of the second insulating element and the second surface of the second metal oxide varistor;

a second thermo-sensitive piece which is conductive and solid colloid to be disposed in the through hole of the second insulating element, electrically connecting the electrical connector and the second surface of the second metal oxide varistor; and a pushing element having a first end thereof arranged correspondingly to the second surface of the second metal oxide varistor, the second insulating element and the electrical connector, and a second end thereof arranged correspondingly to the binary alloy conductive plate for pushing;

whereby when the first connecting point is contacting the second connecting point and an overvoltage occurs, temperature of either of the metal oxide varistors would instantly rise up to a degree higher than the melting point thereof, therefore melting a corresponding thermo-sensitive piece, loosening the springy section of the spring element and displacing the pushing element to force the first connecting point detaching from the second connecting point and turn off the switch; meanwhile, either of the insulating elements also disconnects either of the circuit structures simultaneously.

6. The switch module with a built-in structure of anti-surge and dual disconnection as claimed in claim 5, wherein the electrical connector is made of a spring, and the first end of the pushing element has a positioning hole for engagement with the springy section.

7. The switch module with a built-in structure of anti-surge and dual disconnection as claimed in claim 5, wherein the plate is connected to the third conductive plate or to the ground.

8. A switch module with a built-in structure of anti-surge and dual disconnection, comprising:

a housing having a press button arranged atop thereof, and a first conductive plate, a second conductive plate and a third conductive plate arranged at a lower section thereof; said first conductive plate being connected to a binary alloy conductive plate having a first connecting point, and the second conductive plate having a second connecting point on the surface of an upper section thereof corresponding to the first connecting point;

a moving rod linking up the bottom of the press button with one end and the binary alloy conductive plate with the other end for the first connecting point to contact the second connecting point, consequently turning on the switch, and for the first connecting point to detach from the second connecting point when current overload occurs and the binary alloy conductive plate is deformed due to high temperature, consequently turning off the switch, so as to form an overcurrent protection switch;

wherein a structure of anti-surge and dual disconnection is built inside the housing, including:

a first metal oxide varistor being disposed under a plate and having a first surface and an opposite second surface;

a first insulating element having a through hole arranged at a center thereof, an upper surface and a lower surface, said upper surface arranged correspondingly to the first surface of the first metal oxide varistor;

a conductive first spring element having an outer periphery with a first extended portion connecting the first surface of the first metal oxide varistor with the second conductive plate, and a springy section being compressed in the through hole of the first insulating element by the first surface of the first metal oxide varistor;

a first thermo-sensitive piece which is conductive and solid colloid to be disposed in the through hole of the first insulating element for the springy section of the first spring element to be compressed and adhered between the lower surface of the first insulating element and the first surface of the first metal oxide varistor for electrical connection and for the first spring element to be ready for ejection;

a second metal oxide varistor having a first surface and an opposite second surface; said first surface compressing the first spring element;

a second insulating element having a through hole arranged at a center thereof, an upper surface and a lower surface, said upper surface arranged correspondingly to the second surface of the second metal oxide varistor;

a conductive second spring element having an outer periphery with a second extended portion electrically connecting the second surface of the second metal oxide varistor with the third conductive plate, and a springy section being compressed in the through hole of the second insulating element by the second surface of the second metal oxide varistor;

a second thermo-sensitive piece which is conductive and solid colloid to be disposed in the through hole of the second insulating element for the springy section of the second spring element to be compressed and adhered between the lower surface of the second insulating element and the second surface of the second metal oxide varistor for electrical connection and for the second spring element to be ready for ejection;

a third metal oxide varistor having a first surface and an opposite second surface; said second surface compressing the second spring element;

a third insulating element having a through hole arranged at a center thereof, an upper surface and a lower surface, said upper surface arranged correspondingly to the first surface of the third metal oxide varistor;

an electrical connector having an outer periphery with a third extended portion electrically connecting to the third metal oxide varistor and the plate with the ground, and a springy section being compressed under the third insulating element and the first surface of the third metal oxide varistor;

a third thermo-sensitive piece which is conductive and solid colloid to be disposed in the through hole of the third insulating element for the springy section of the electrical connector to be compressed and adhered between the lower surface of the third insulating element and the first surface of the third metal oxide varistor for electrical connection and for the electrical connector to be ready for ejection; and a pushing element having a first end thereof arranged correspondingly to the first surface of the third metal oxide varistor, the third insulating element and the electrical connector, and a second end thereof arranged correspondingly to the binary alloy conductive plate for pushing;

whereby when the first connecting point is contacting the second connecting point and an overvoltage occurs, temperature of either of the metal oxide varistors would instantly rise up to a degree higher than the melting point thereof, therefore melting a corresponding thermo-sensitive piece, loosening the springy section of a corresponding spring element and displacing the pushing element to force the first connecting point detaching from the second connecting point and turn off the switch; meanwhile, either of the insulating elements also disconnects either of the circuit structures simultaneously.

9. The switch module with a built-in structure of anti-surge and dual disconnection as claimed in claim 8, wherein the plate further has a conductive element to be electrically connected to the third extended portion of the electrical connector, and the electrical connector is made of a spring and has an outer periphery and a springy section being compressed by the third insulating element and the first surface of the third metal oxide varistor; and the pushing element further has a positioning hole to engage with the springy section of the electrical connector.

* * * * *